US005778617A

United States Patent [19]

Free

[11] Patent Number: 5,778,617

[45] Date of Patent: Jul. 14, 1998

[54] PRESS-ON CORNER BEAD

[76] Inventor: Gerald R. Free, 302 Rte. 214, Phoenicia, N.Y. 12464

[21] Appl. No.: 549,034

[22] Filed: Oct. 27, 1995

[51] Int. Cl.[6] ..... E04G 11/00

[52] U.S. Cl. ..... 52/255; 52/254; 52/257; 411/466

[58] Field of Search ..... 52/255, 256, 257, 52/254; 411/442, 443, 444, 466, 467, 468

[56] References Cited

U.S. PATENT DOCUMENTS

| | | | |
|---|---|---|---|
| D. 29,728 | 11/1898 | Roberts . | |
| 201,098 | 3/1878 | Darby . | |
| 450,753 | 4/1891 | Cary . | |
| 778,809 | 12/1904 | Stokes . | |
| 851,583 | 4/1907 | Allen . | |
| 1,019,951 | 3/1912 | Congill . | |
| 1,185,231 | 5/1916 | Miller . | |
| 1,212,219 | 1/1917 | Hescheles . | |
| 1,373,036 | 3/1921 | Upson . | |
| 1,440,615 | 1/1923 | Meyercord . | |
| 1,804,564 | 5/1931 | McChesney . | |
| 1,917,920 | 7/1933 | Bliss . | |
| 2,041,799 | 5/1936 | Walper . | |
| 2,174,145 | 9/1939 | Tummins . | |
| 2,234,701 | 3/1941 | Lyman . | |
| 2,379,179 | 6/1945 | Petersen . | |
| 2,540,106 | 2/1951 | Eichelberger . | |
| 2,593,859 | 4/1952 | Dunlap . | |
| 2,643,423 | 6/1953 | Brendel . | |
| 2,728,514 | 12/1955 | Holtkamp . | |
| 2,826,352 | 3/1958 | Holtkamp . | |
| 2,851,741 | 9/1958 | Stemples . | |
| 2,859,445 | 11/1958 | Larrabee . | |
| 2,862,264 | 12/1958 | Perna . | |
| 2,904,856 | 9/1959 | Robinson . | |
| 3,020,602 | 2/1962 | Siering . | |
| 3,090,087 | 5/1963 | Miller . | |
| 3,109,207 | 11/1963 | Cooper . | |
| 3,140,493 | 7/1964 | Ennis . | |
| 3,255,561 | 6/1966 | Cable . | |
| 3,305,252 | 2/1967 | Jureit . | |
| 3,323,264 | 6/1967 | Cross . | |
| 3,485,001 | 12/1969 | Miller . | |
| 3,498,171 | 3/1970 | Jureit . | |
| 3,881,293 | 5/1975 | Conville . | |
| 4,288,016 | 9/1981 | Failla et al. . | |
| 4,324,079 | 4/1982 | Pearson . | |
| 4,593,443 | 6/1986 | Wolford . | |
| 4,670,957 | 6/1987 | Wolford . | |
| 4,863,774 | 9/1989 | Tucker . | |
| 4,876,837 | 10/1989 | Kelly et al. . | |
| 4,977,718 | 12/1990 | Hoffman, Sr. . | |
| 5,037,686 | 8/1991 | Conboy . | |
| 5,048,247 | 9/1991 | Weldy . | |
| 5,131,198 | 7/1992 | Ritchie et al. . | |
| 5,138,810 | 8/1992 | Kartler | 52/254 |
| 5,442,886 | 8/1995 | Iacobelli | 52/255 |

FOREIGN PATENT DOCUMENTS

| | | | |
|---|---|---|---|
| 460961 | 11/1949 | Canada . | |
| 17763 | 11/1895 | United Kingdom . | |
| 797887 | 7/1958 | United Kingdom | 52/255 |

*Primary Examiner*—Carl D. Friedman
*Assistant Examiner*—Timothy B. Kang
*Attorney, Agent, or Firm*—Tilton, Fallon, Lungmus & Chestnut

[57] ABSTRACT

A drywall corner bead which includes a plurality of integral preformed barbs provided at intervals along the length of the corner bead for securing the corner bead to a drywall corner. The corner bead includes first and second longitudinally-extending flanges which are interconnected by a longitudinally-extending rounded nose, and the first and second flange are disposed at an angle of less than 90° with respect to each other. The barbs project inwardly from the flanges in a generally perpendicular direction and have a length of less than about 3/32 of an inch. When the corner bead is applied to a drywall corner, the barbs penetrate substantially only the paper layer of the underlying drywall and secure the corner bead to the corner. The drywall corner bead can be rapidly applied to a corner without requiring additional tools or materials, and the corner bead is securely affixed to the corner by the barbs until the corner is finished with joint compound and paint.

23 Claims, 2 Drawing Sheets

FIG. 1
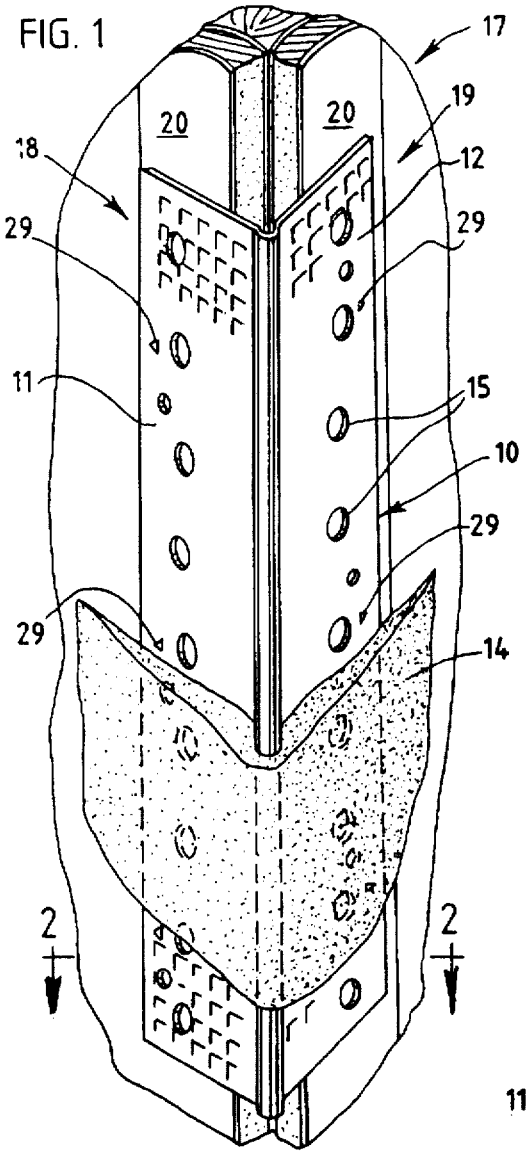
FIG. 2
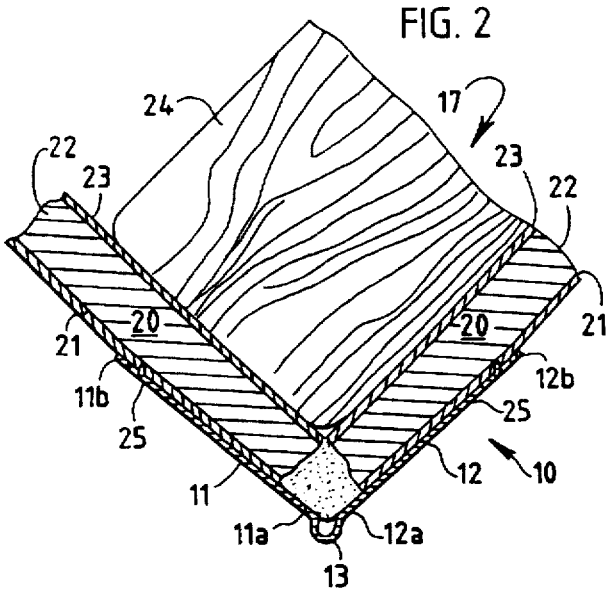
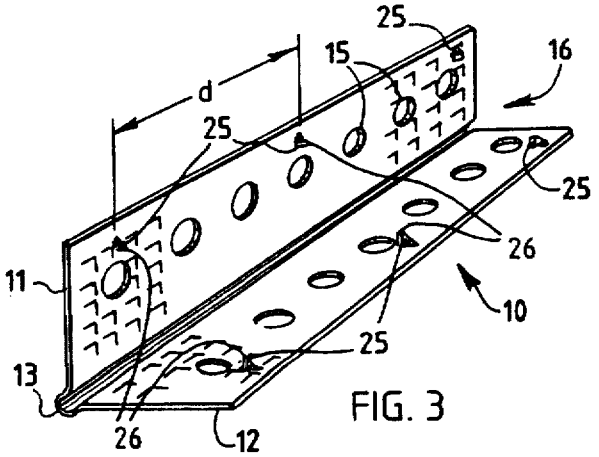
FIG. 3
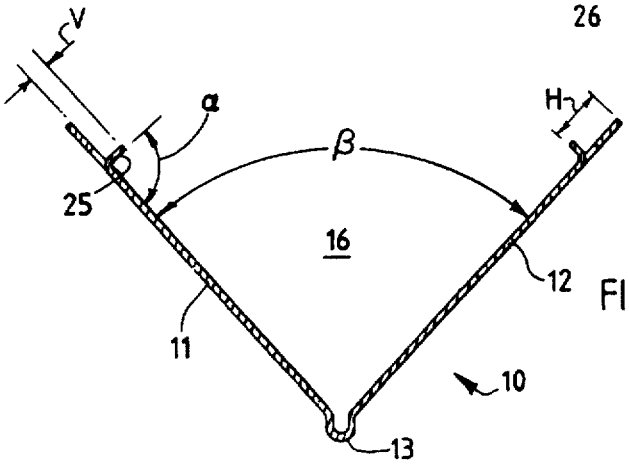
FIG. 4

FIG. 5
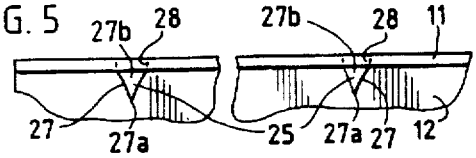
FIG. 6
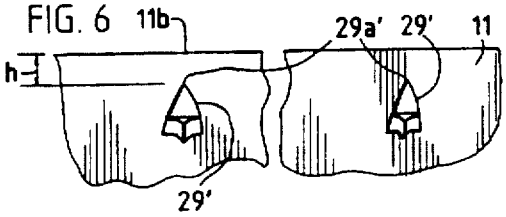
FIG. 7
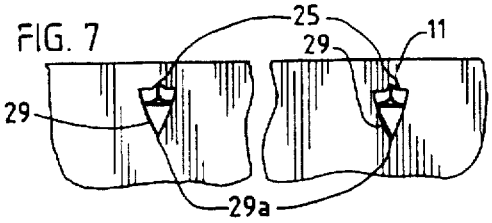
FIG. 8
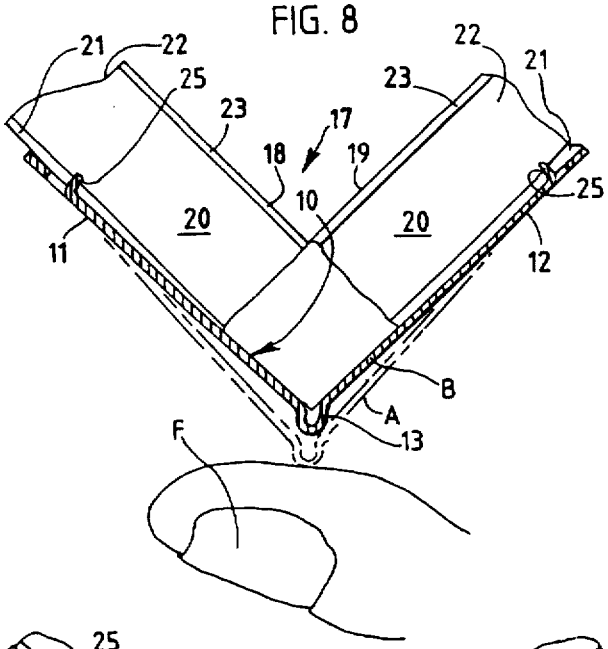
FIG. 10
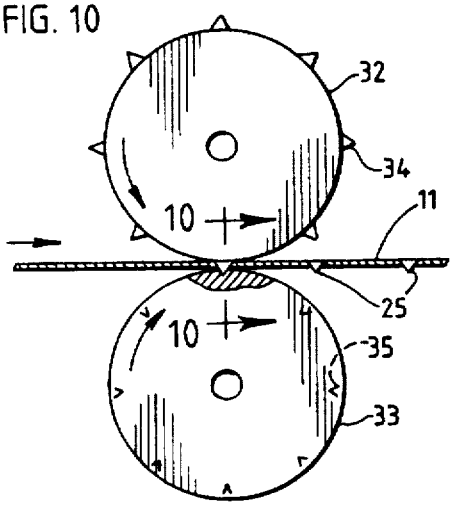
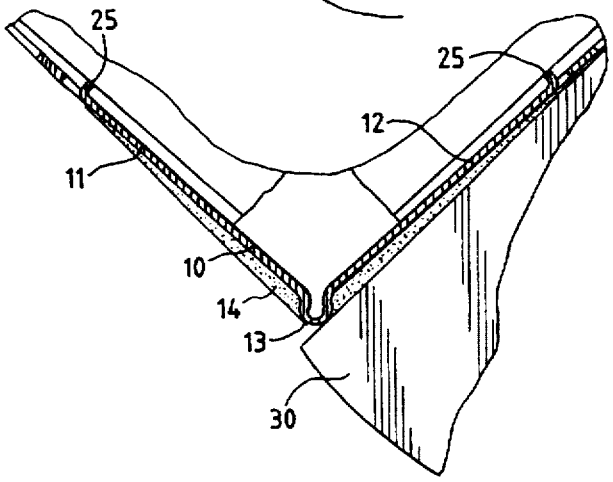
FIG. 9
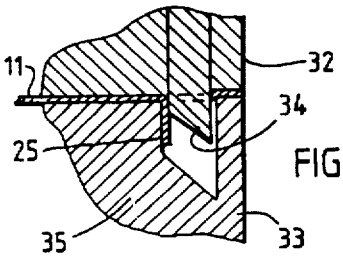
FIG. 11

PRESS-ON CORNER BEAD

BACKGROUND AND SUMMARY

This invention relates to the construction of walls from drywall and, more particularly, to sheet metal corner beads which are applied to the corners of intersecting walls made of drywall.

Corner beads are generally applied to a corner by first temporarily securing the corner bead to a corner and then applying joint compound to the corner bead which permanently secures the corner bead to the corner and forms the finished surface. Such corner beads usually include a plurality of apertures or holes so that the joint compound can infiltrate the corner bead and form a secure bond over the corner bead and the underlying drywall. While applying joint compound to the corner bead provides an adequate permanent attachment of the corner bead to the corner, the current methods for temporarily securing the corner bead to the corner prior to applying the joint compound have been time-consuming processes and the results have often been inadequate.

In one prior method, the corner bead is secured to the corner by inserting nails or screws through the apertures and into the underlying walls. However, the process is time-consuming since the nails or screws must be provided every four to six inches or so along the length of both flanges, and the process requires tools, such as a hammer or a screwgun and powercord, as well as additional materials such as nails and screws which are an additional expense. In addition, the hammering or screwing operations often deform the corner bead or the underlying or adjacent drywall which requires additional labor to fix when the wall surface is finished.

In another prior art method, the corner bead is installed by first applying joint compound or adhesive to the corner, and then applying the corner bead to the corner so that the joint compound or adhesive permeates the holes and secures the corner bead to the corner once it dries. However, the application of joint compound or adhesive under the corner bead is messy, and the results are often inadequate because the corner bead may move by gravity or impact before the joint compound or adhesive dries. Using joint compound or adhesive to temporarily secure the corner bead to a corner is also problematic in that they can only be used in certain environments with acceptable temperatures. Thus, such methods are not a viable option for use at construction sites which are open to inclement weather. This method is also time-consuming, and there is significant down time while installers wait for the joint compound or adhesive to dry.

In order to overcome the prior art problems encountered with nailing, screwing or adhesively bonding corner beads to drywall, many patents have proposed using a tool for crimping the corner bead while it is on the corner to secure it to the drywall. Such devices are disclosed, for example, in U.S. Pat. Nos. 4,670,957; 4,593,443; and 2,859,445. Typically, such crimping tools are fitted to the corner bead and struck with a mallet so that opposed prongs slash the opposite edges of the corner bead. This forms slashed edges on the flanges which dig into the drywall. The process is then repeated along the length of the corner bead typically at 4–6 inch intervals from top to bottom. While using such crimping tools is probably the most common current method of installing drywall corner beads, using such devices is still problematic for many reasons.

First, repeatedly striking the crimping tool vibrates the corner bead, and pounding on lower portions of the corner bead will often force the previously installed upper portions of the corner bead to become dislodged. Secondly, the slashed edges of the corner bead dig into the gypsum of the drywall which forms bulges that must be covered when the wall is finished. Thirdly, such tools must have a uniform angle, typically 90 degrees, but that angle does not necessarily conform to drywall corners which are often out of square. Fourth, while the slashed edges of the corner bead secure the corner bead in an up and down direction, the holding power of the slashed edges is limited in the transverse direction and it is easy for such installed corner beads to be knocked off. Lastly, the process of crimping a corner bead every 4 to 6 inches along its length is very time-consuming.

The prior art methods of nailing, screwing, adhesively bonding, and crimping drywall corner beads to walls all involve time-consuming methods which achieve less than successful results. Accordingly, it is believed that there is a need in the industry for an efficient means for rapidly installing corner beads, without requiring additional tools or materials, and adequately securing the corner bead to a corner until the wall is finished with joint compound and paint.

An important aspect of this invention therefore lies in providing a unique drywall corner bead which does not require additional tools or materials for securing it to a corner and which can be rapidly applied to a wall and provide a secure attachment thereto. Such a construction takes the form of a drywall corner bead which includes integral securement means for attaching it to a wall. The corner bead may be quickly and securely applied to a drywall corner by simply pressing the corner bead onto the corner. To install the inventive corner bead, the corner bead is positioned on a drywall corner, and then, the installer simply presses the corner bead against the wall by running his hand along the length of the corner bead which results in it being securely attached to the wall until the wall is ready for being finished with joint compound and paint.

Briefly, the drywall corner bead of this invention comprises a pair of first and second longitudinally extending flanges which are secured together at their inner edges by a rounded nose. The flanges are disposed at an angle of less than 90° with respect to each other and form an acute corner therebetween. The flanges each include a plurality of aperture means for allowing joint compound to pass through the flanges when the wall is finished. Securement means are provided at intervals along the length of both the first and second flanges for penetrating substantially only the paper layer of a drywall sheet and securing the corner bead to a corner formed from two planar sheets of drywall. By only penetrating the paper layer of the drywall sheets, the securement means adequately holds the corner bead on the drywall sheet by gripping the paper which has a high tensile strength as compared to the underlying gypsum which is brittle, crumbly, and has a low tensile strength. In addition, the securement means prevents the flanges from being moved in directions parallel to the walls but allows an installer to easily remove the corner bead, if desired, by pulling the flanges away from the drywall sheets in a perpendicular direction thereto.

In the preferred embodiment, the securement means take the form of a plurality of integral preformed barbs which project inwardly from said flanges in a generally perpendicular direction and have a length of less than about 3/32 of an inch. The barbs are designed so that they substantially only penetrate the paper of the drywall and do not substantially invade the underlying gypsum. The inventor has found that such barbs, in combination with the flanges which form an acute angle, provide a tremendous holding power for securing the corner bead to a drywall corner without requiring tools or additional materials. Most advantageously, the corner bead with the integral barbs can be installed in significantly less time than any of the other prior art methods.

In a preferred embodiment, the first and second flanges form an angle of approximately 70° to 80° therebetween, and the barbs are positioned along the length of the flanges in opposed alignment. When the corner bead is pressed onto a drywall corner, the opposed barbs penetrate the paper and the acute angle of the corner bead presses the barbs towards each other to form a secure hold on the drywall. Preferably, the barbs are punched from the flanges and connected to the flanges by rounded bent portions. The barbs preferably have a triangular shape and form a pointed distal tip for penetrating the paper of the drywall. Such barbs leave a triangularly-shaped hole in the flanges which preferably have their points directed towards the inner edges of the flanges. However, the points of the triangularly-shaped holes may instead be directed towards the outer edges of the flanges.

In the method of this invention, a preformed drywall corner bead is provided which includes first and second longitudinally-extending flanges which are secured together by a rounded nose. The flanges form an acute angle therebetween, and the flanges each include a plurality of integrally-formed barbs which project inwardly from said flanges in a generally perpendicular direction and have a length of less than about 1/16 inch. The corner bead is first positioned on a corner so that the first flange is positioned on one of the planar wall portions and the second flange is positioned on the other of the planar wall portions. Then, the installer presses the corner bead against the corner so that the barbs penetrate substantially only a paper layer of the planar wall portions and secure the corner bead thereto. Thereafter, joint compound may be applied to the corner bead for finishing.

Other objects, features, and advantages of the present invention will become apparent from the following drawings and description.

BRIEF DESCRIPTION OF THE DRAWINGS

FIG. 1 is a perspective, partially broken away, view of the drywall corner bead of this invention shown attached to a wall corner.

FIG. 2 is a top cross sectional view taken along line 2—2 of FIG. 1 and illustrating the drywall corner bead embodying this invention in combination with a wall corner.

FIG. 3 is a perspective view of the drywall corner bead embodying this invention.

FIG. 4 is an end view of the drywall corner bead embodying this invention.

FIG. 5 is a side view of one of the flanges of the drywall corner bead embodying this invention.

FIG. 6 is a side view of one of the flanges of the drywall corner bead embodying this invention.

FIG. 7 is a side view of one of the flanges of an alternate embodiment of the drywall corner bead of this invention.

FIG. 8 is a top view illustrating the drywall corner bead of this invention being pressed onto a drywall corner.

FIG. 9 is a perspective, somewhat schematic, view showing the step of applying joint compound to a drywall corner bead of this invention.

FIG. 10 is a schematic side elevational view of the cutting rolls which form the barbs in the flanges of the drywall corner bead of this invention.

FIG. 11 is an enlarged schematic view illustrating the engagement of a cutting tooth of one of the cutting wheels with the flange of the drywall corner bead of this invention to form a barb.

DETAILED DESCRIPTION OF THE PREFERRED EMBODIMENTS

Referring to the drawings, the numeral 10 generally designates the drywall corner bead of the present invention. Corner bead 10 includes a first longitudinally-extending flange 11 having an inner edge 11*a* and an outer free edge 11*b* and further includes a second longitudinally-extending flange 12 having an inner edge 12*a* and an outer free edge 12*b*. A longitudinally-extending rounded nose 13 interconnects the inner edges 11*a* and 12*a* of the flanges 11 and 12. The flanges 11 and 12 are provided with aperture means for allowing joint compound 14 to pass through the flanges and to contact underlying drywall when the corner bead is finished (FIG. 1). As shown, the aperture means preferably take the form of a plurality of holes 15 which are formed at intervals along the length of the flanges 11 and 12. The corner bead 10 may be formed of sheet metal, and details of the construction of particularly advantageous drywall corner bead, and a method of making it, are disclosed in U.S. Pat. No. 4,876,837.

The inventive aspect of this invention lies primarily in the orientation of the flanges 11 and 12 with respect to each other and the provision of securement means along the flanges for securing the corner bead to a drywall corner. Specifically, the first flange 11 is disposed at an angle β of less than 90° with respect to the second flange 12 as shown in FIG. 4. The flanges 11 and 12 therefore form an acute corner therebetween which is generally designated with the numeral 16. Preferably, the angle β is approximately 70° to 80°. Accordingly, when the corner bead is applied to a drywall corner having a greater angle (typically 90°), the flanges 11 and 12 are pushed outward and are resiliently biased to grip the corner.

The drywall corner bead 10 is shown in combination with a corner wall structure generally designated at 17 in FIGS. 1 and 2. Wall structure 17 includes two planar wall portions 18 and 19 which are each formed of a drywall sheet 20. Drywall sheets 20 are standard pieces of drywall and include an outer paper layer 21 and an underlying gypsum layer 22. The drywall sheets 20 also include inner paper layers 23 which are adjacent to the underlying structure 24 (which structure is shown as a being formed of wood), although other common underlying structures, such as metal studs, may be used under the drywall sheets. The planar wall portions 18 and 19 are secured to the underlying structure 24 by screws or nails in a conventional fashion (not shown).

Securement means are provided at intervals along the length of flanges 11 and 12 for penetrating substantially only the paper layer 21 of the drywall sheets 20 and securing the corner bead 10 to the corner wall structure 17. Advantageously, the securement means grips the paper layer 21 and prevents the flanges 11 and 12 from being moved in directions parallel to planar wall portions 18 or 19. However, the securement means is releasable from the drywall sheets 20 when the flanges 11 and 12 are pulled away from the drywall sheets 20 in a perpendicular direction thereto. Such removal is facilitated by pulling or removing one flange 11 or 12 at a time.

In the embodiment given in the illustrations, the securement means take the form of a plurality of integral preformed barbs 25 which are disposed at intervals along the length of the flanges 11 and 12. As shown most clearly in FIG. 4, each of the barbs 25 projects inwardly from the flanges 11 and 12 in a generally perpendicular direction with respect to the flanges and has a length L of less than 3/32 of an inch. In the preferred embodiment, the angle α between the barbs 25 and the flanges 11 and 12 is approximately 90 degrees. However, there may be some variation in the angle due to manufacturing tolerances. In any event, the barbs 25 preferably project in a generally perpendicular direction with respect to the flanges 11 and 12. The barbs 25 preferably have a length of less than about 3/32 inch so that they substantially penetrate only the paper layer 21 of a drywall sheets 20 and do not substantially invade the underlying gypsum 22. In the preferred form, the barbs 25 have a length of approximately 2/32 to 3/32 inches. Forming the barbs 25 to have a length L of less than 3/32 inch has been found to be particularly advantageous since the barbs substantially penetrate only the paper of the drywall and do not substantially invade the underlying gypsum as shown in FIG. 2. Accordingly, the barbs 25 do not cause any substantial displacement of the gypsum 22 which could otherwise cause the gypsum 22 to form bulges or other deformations which would require correction during finishing of the wall structure.

Referring to FIG. 3, the barbs 25 are positioned at intervals along the length of flanges 11 and 12 with a predetermined distance d between sequential barbs 25. In the preferred embodiment, the distance d is equal to approximately 2 inches. Such an interval ensures that, when a particular corner bead 10 is cut to fit a particular wall structure, a barb 25 will be closely adjacent to the cut end portion for securing it to the drywall. As shown, the barbs 25 are also preferably provided in pairs generally designated at 26 in which the barbs 25 provided on the first flange 11 are positioned in transverse alignment with the barbs 25 on the second flange 12. Providing the barbs 25 in opposed pairs 26, in combination with the pre-formed acute corner 16 of the corner bead 10, ensures that the barbs 25 form a firm grip on the drywall sheets 20. If desired, the barbs could also be placed in a staggered configuration or could be placed in double or triple arrangements of closely-spaced barbs.

In the particular embodiments illustrated in FIGS. 5–7, the barbs 25 have a triangular shape 27 which includes a distal pointed tip **27*a* and a bent portion 27*b* which is integral with the flange 11. The distal pointed tip 27*a* of the triangular shape 27 is the furthermost point of the barb 25 away from the flange 11. As shown, the barbs 25 are punched from the flanges 11 and 12, and the barbs 25 are integrally connected to the flanges by the rounded or bent portions 27*b*. This leaves triangularly-shaped holes 29 in the flanges adjacent to each of the barbs 25. Preferably, the points 29*a* of the triangularly-shaped holes 29 are directed towards the outer edges 11*b* or 12*b* of the flanges 11 and 12 as shown in FIG. 7. That is, the barbs 25 are formed by punching those sections outwardly. In an alternate embodiment shown in FIG. 6, the barbs 25 are formed by punching the barbs 25 inwardly so that the points 29*a*' of the triangularly-shaped apertures 29' are directed towards the outer edges 11*a* or 12*a* of the flanges 11 and 12. However, the embodiment shown in FIG. 7, in which the tips 29*a* of the holes 29** are directed towards the inner edges of the flanges, is the preferred construction.

The holes 29 from which the barbs 25 are formed are preferably positioned inwardly a predetermined distance h away from the outer edges **11*b* and 12*b* of the flanges 11 and 12. This is so that the outer edges 11*b* or 12*b* of the flanges 11 and 12 remain intact; otherwise, if the outer edges 11*b* or 12*b* were broken, the broken edges may form an uneven appearance and may be inadequately secured to the wall. This results in the barbs 25 being positioned inwardly from the outer edges 11*b* and 12*b* a predetermined distance H as shown in FIG. 4**. Preferably, the distance H is approximately 1/16–1/8 inches.

The method of this invention of installing the corner bead 10 will now be described with reference to FIGS. 8 and 9. First, a corner bead 10 made in accordance with this invention is provided and the installer cuts it to length to fit upon a particular wall structure (step not shown). The installer then positions the corner bead 10 on the corner wall structure 17 so that the first flange 11 is positioned on one of the planar wall portions 18 formed of drywall 20 and the second flange 12 is positioned on the other planar wall portion 19 also formed of a sheet of drywall 20 as represented by the phantom lines in which the corner bead 10 is in position A. Then, the installer uses his fingers F, or the palm or heel of the hand depending upon preference, to press the nose 13 of the corner bead 10 against the corner 17 so that the barbs 25 penetrate the paper layer 21 of the planar wall portions 18 and 19 and secure the corner bead 10 thereto as illustrated by the corner bead 10 in position B. Preferably, as previously described, the first flange 11 and second flange 12 are disposed at an acute angle β of approximately 70° to 80° and the step of pressing the corner bead 10 onto the corner 17 includes manipulating the corner bead 10 so that the angle β conforms to an angle of the corner 17 (typically about 90°). This presses the flanges 11 and 12 outward so that they are resiliently biased inward onto the corner 17 to hold the barbs 25 in position. In a particularly advantageous method of rapidly applying the corner bead 10 to a corner wall structure 17, the pressing step is started at one end of the corner bead 10 and the installer sequentially works along the length of the corner bead 10, pressing the barbs 25 into the paper layer 21 of the drywall sheets 20, until the installer reaches the other end of the corner bead. In this manner, the corner bead 10 can be installed in substantially less time than prior art corner beads which were installed by the prior methods of nailing, screwing, adhesively bonding, or crimping corner beads to a corner wall structure. Lastly, the corner wall structure 17 is finished by applying joint compound 14 to the corner bead 10 with a suitable tool 30 to form a smooth outer surface over the corner bead 10.

As mentioned, the corner bead 10 can be constructed generally in accordance with the teachings of U.S. Pat. No. 4,876,837 except for the inventive aspects of the preformed angle and securement means of the corner bead. The acute angle of the corner bead 10 can be accomplished using conventional methods of forming sheet metal corner beads by forming the corner bead 10 to the desired angle instead of a traditional angle of 90°. The process steps for forming the preferred securement means, barbs 25, is discussed in connection with FIGS. 10 and 11.

Specifically, the barbs 25 may be formed by running the flanges (flange 11 in the illustrations) through a pair of cutting wheels 32 and 33. The cutting wheel 32 includes a plurality of teeth 34 which are shaped to form the barbs 25. Cutting wheel 35 includes a plurality of respective receiving wells 35 for accommodating the punched barbs 25 and the cutting teeth 34 when the flange 11 is run between the wheels 32 and 33. The engagement of a cutting tooth 34 and a receiving wheel 35 is shown in FIG. 11. As shown, the triangularly-shaped cutting tooth 34 punches the barb 25 out of the sheet metal material of flange 11 by bending the barb 25 downward against the receiving well 35 so that the barb 25 extends in a generally perpendicular direction with respect to the flange 11. While one method of forming the securement means, barbs 25, in the flanges of the corner bead 10 has been described, it will be understood by those skilled in the art that other manufacturing methods may also be employed.

The inventive corner bead 10 of this invention is highly advantageous in that it can be rapidly applied to a corner wall structure 17 in significantly less time than was required to apply the prior art corner beads using the prior art methods. In addition to the significant savings in labor, the corner bead 10 is also particularly advantageous in that it does not require additional tools or materials for it to be secured to a corner wall structure 17. Lastly, the securement means which is provided on the corner bead 10 provides a surprisingly effective hold on the corner wall structure 17 which prevents the corner bead from being inadvertently knocked off of the wall structure.

While in the foregoing embodiments of the invention have been disclosed in considerable detail for purposes of illustration, it will be understood by those skilled in the art that many of these details may be varied without departing from the spirit and scope of the invention.

I claim:

1. A drywall corner bead comprising:

first and second longitudinally-extending flanges which each include inner and outer edges;

a longitudinally-extending rounded nose which interconnects said inner edges of said first and second flanges, said first flange being disposed at an angle in a range of 70 to 80 degrees with respect to said second flange so that the first and second flanges form a substantially acute corner in an uninstalled condition of said corner bead;

a plurality of integral preformed barbs provided at intervals along each of said first and second flanges in a generally perpendicular direction, said barbs of said first flange being in transverse alignment with said barbs of said second flange;

each of said barbs being interconnected to said flanges by an integral bent portion and being positioned adjacent to a hole in said flange, each of said holes including a pointed tip opposite from said bent portion of said barb, said pointed tip being directed toward said inner edges of the flanges.

2. The invention of claim 1 in which said barbs have a length of less than about 3/32 of an inch.

3. The invention of claim 1 in which said barbs are spaced a predetermined distance apart along a length of said first and second flanges.

4. The invention of claim 3 in which said predetermined distance is approximately two inches.

5. The invention of claim 1 in which each of said barbs has a triangular shape which includes a straight edge and an opposite pointed distal tip, said straight edge forming said integral bent portion and said distal tip forming an outermost portion of each of said barbs.

6. The invention of claim 5 in which each of said holes is triangular-shaped.

7. The invention of claim 1 in which said barbs are positioned inwardly of said outer edges of said flanges by a distance of approximately 1/16 to 1/8 inches.

8. A drywall corner bead in combination with a corner of two intersecting drywall sheets, said combination comprising:

a corner bead having first and second longitudinally-extending flanges which each include inner and outer edges;

a longitudinally-extending rounded nose which interconnects said inner edges of said first and second flanges; and integral pre-formed securement means provided at intervals along said flanges operable to secure said corner bead in a mounted condition without substantially invading an underlying gypsum core of said drywall sheets, said flanges being splayed apart and resiliently biased to grip said corner and said integral preformed securement means penetrates through the thickness of an outer paper layer of said drywall sheets for securing said corner bead to the corner formed intersecting drywall sheets.

9. The invention of claim 8 in which said securement means is operable to prevent said flanges from being moved in directions parallel to surfaces to which said corner bead is secured.

10. The invention of claim 9 in which said securement means on said flanges is operable to be releasable from surfaces to which the corner bead is applied when said flanges are pulled in directions apart from one another so as to increase the angle at which said first flange is disposed with respect to said second flange.

11. In a wall structure including two planar wall portions formed of drywall sheets having an outer paper layer and underlying gypsum material, said drywall sheets intersecting at a corner, and a drywall corner bead mounted on said corner with a flange secured to each of said wall portions, the improvement comprising said flanges of said corner bead including a plurality of integral preformed barbs which project inwardly from said flanges and penetrate substantially only the thickness of said outer paper layer of said drywall sheets for securing said corner bead thereto without substantially invading the underlying gypsum material, said barbs projecting from said flanges in a generally perpendicular direction.

12. The invention of claim 11 in which said barbs have a length of less than about 3/32 inch.

13. A method of applying a drywall corner bead to a wall structure which includes two planar wall portions formed of drywall sheets having an outer paper layer, the planar wall portions intersecting at a corner, said method comprising the steps of:

providing a preformed drywall corner bead comprising first and second longitudinally-extending flanges which are secured together by a rounded nose and define an acute angle therebetween, said flanges each including a plurality of integrally-formed barbs which project inwardly from said flanges in a generally perpendicular direction thereto, said barbs having a length at least equal to the thickness of the outer paper layer of the drywall sheets so as to penetrate and grip substantially only the outer paper layer of said planar wall portions;

positioning said corner bead on said corner so that said first flange is positioned on one of the planar wall portions and said second flange is positioned on the other of the planar wall positions; and then, pressing said corner bead against said corner so that said barbs penetrate and grip substantially only said outer paper layer of said planar wall portions to secure said corner bead thereto.

14. The method of claim 13 in which said barbs have a length of less than 3/32 inch.

15. The method of claim 13 in which said first flange is disposed at an angle with respect to said second flange of approximately 70–80 degrees and said step of pressing said corner bead onto said corner includes manipulating said corner bead so that said angle conforms to an angle of said corner.

16. The method of claim 13 in which said step of pressing said corner bead against said corner further includes beginning said pressing step at one end of said corner bead and sequentially working along a length of said corner bead to the other end of the corner bead.

17. The method of claim 13 comprising the further step of applying joint compound to said corner bead.

18. A drywall corner bead comprising:

first and second longitudinally-extending flanges which each include inner and outer edges;

a longitudinally-extending rounded nose which interconnects said inner edges of said first and second flanges, said first flange being disposed at an angle in a range of 70 to 80 degrees with respect to said second flange so that the first and second flanges form a substantially acute corner in an uninstalled condition of said corner bead;

a plurality of integral preformed barbs provided at intervals along each of said first and second flanges in a generally perpendicular direction, said barbs of said first flange being in transverse alignment with said barbs of said second flange;

each of said barbs being interconnected to said flanges by an integral bent portion and being positioned adjacent to a hole in said flange, each of said holes including a pointed tip opposite from said bent portion of said barb, said pointed tip being directed toward said outer edges of the flanges.

19. The corner bead of claim 18, in which said barbs are positioned a distance of approximately two inches apart along a length of said first and second flanges.

20. The corner bead of claim 18, in which said barbs are positioned inwardly of said outer edges of said flanges by a distance of approximately 1/16 to 1/8 inches.

21. The corner bead of claim 18 in which said pointed tips of said holes are spaced inwardly from said outer edges of said flanges.

22. An improved drywall corner bead in combination with a substantially right-angled corner of two drywall sheets, said corner bead having first and second longitudinally-extending flanges which each include inner and outer edges and a longitudinally extending rounded nose which interconnects said inner edges of said first and second flanges, said improvement comprising:

each of said flanges including a plurality of integral barbs projecting toward the opposite flange and said flanges being splayed apart for installation of said corner bead on said corner of two drywall sheets, whereby said splayed flanges are resiliently biased toward one another in an installed condition of said corner bead;

said barbs penetrating into and through an outer paper layer of each of said drywall sheets;

said barbs and said resilient biasing of said flanges together providing an attachment means that is sufficient to hold said corner bead in the installed condition on said substantially right-angled corner of said drywall sheets for finishing joint treatment to be applied to said substantially right-angled corner and said corner bead.

23. The improvement of claim 22, wherein said flanges are splayed from an uninstalled angle between said flanges that is in a range of 70 to 80 degrees.

* * * * *